US006082724A

United States Patent [19]

Kahlig et al.

[11] Patent Number: 6,082,724

[45] Date of Patent: Jul. 4, 2000

[54] VARIABLE SPEED SIGNATURE COLLATING APPARATUS

[75] Inventors: Daniel Lee Kahlig, Union; David Upton Johnson, Dayton, both of Ohio

[73] Assignee: Heidelberger Druckmaschinen AG, Heidelberg, Germany

[21] Appl. No.: 08/905,061

[22] Filed: Aug. 1, 1997

[51] Int. Cl.[7] ..... B65H 39/02

[52] U.S. Cl. ..... 270/52.14; 270/52.19; 270/52.26

[58] Field of Search ..... 270/52.14, 52.2, 270/52.15, 52.16, 52.19, 52.21, 52.22, 52.26

[56] References Cited

U.S. PATENT DOCUMENTS

| | | | |
|---|---|---|---|
| 3,522,942 | 8/1970 | Hepp | 270/52.14 |
| 3,881,716 | 5/1975 | Bryson et al. | 270/52.15 |
| 3,953,018 | 4/1976 | Maopolski | 270/52.26 |
| 4,500,083 | 2/1985 | Wong | 270/52.05 |
| 4,753,429 | 6/1988 | Irvine et al. | 270/58.06 |
| 5,114,128 | 5/1992 | Harris, Jr. et al. | 270/52.05 |
| 5,213,318 | 5/1993 | Newhall | 270/52.2 |
| 5,286,016 | 2/1994 | Franks | 270/58.04 |
| 5,316,281 | 5/1994 | Bale et al. | 270/52.14 |
| 5,326,087 | 7/1994 | Colson et al. | 270/52.14 |
| 5,326,209 | 7/1994 | Duke | 270/52.05 |
| 5,413,321 | 5/1995 | Banks et al. | 270/52.05 |

FOREIGN PATENT DOCUMENTS 0709331 5/1996 European Pat. Off. .

*Primary Examiner*—Christopher P. Ellis
*Assistant Examiner*—Patrick Mackey
*Attorney, Agent, or Firm*—Tarolli, Sundheim, Covell, Tummino & Szabo L.L.P.

[57] ABSTRACT

An apparatus (20) for forming sheet material assemblages comprises a conveyor assembly (22) having a plurality of locations (60) for receiving sheet material articles. A sheet material article feeder (54) feeds sheet material articles to the receiving locations (60) in the conveyor assembly (22). Each of the sheet material article feeders has an associated individual drive motor (86) for driving a sheet material feeder element, such as drum (93). A feeder sensor assembly (103) provides a signal indicative of the operative position of the feeder element or drum (93). A receiving location sensor assembly (59) provides a signal indicative of the position of a sheet material receiving location (60) approaching a sheet material article feeder. A sheet material feed controller (80) controls the sheet material feed element (93) in response to signals from the feeder sensor assembly (103), the receiving location sensor assembly (59), and a main controller (40).

24 Claims, 4 Drawing Sheets

VARIABLE SPEED SIGNATURE COLLATING APPARATUS

BACKGROUND OF THE INVENTION

The present invention relates to a new and improved apparatus for use in forming sheet material assemblages.

Known apparatus for use in forming sheet material assemblages are disclosed in U.S. Pat. Nos. 5,100,118; 5,186,443; and 5,499,803. An apparatus for use in collating newspapers is disclosed in U.S. Pat. No. 5,186,443. The apparatus disclosed in this patent includes a collating conveyor assembly having a jacket feed station where jackets of newspapers are sequentially fed into upwardly opening pockets. Inserts are fed into each of the jackets in turn at a plurality of insert feed stations. The completed newspapers are transferred to a delivery conveyor assembly which sequentially grips the newspapers and transports them to a receiving location for further processing.

SUMMARY OF THE INVENTION

The present invention relates to a new and improved apparatus for use in forming sheet material assemblages. Although it is preferred to utilize the apparatus in association with the formation of newspapers, it is contemplated that the apparatus could be utilized in association with the formation of other types of sheet material assemblages, such as magazines, pamphlets, or collections of signatures. It is contemplated that the apparatus used in forming the sheet material assemblages could be of the well known hopper and rotary conveyor type inserter utilized to form newspapers. However, the apparatus could be of the saddle or flat back type.

The apparatus for forming the sheet material in assemblages includes a plurality of article feeder assemblies which are disposed along a conveyor. The conveyor is operated to sequentially move article receiving locations past each of the feeder assemblies in turn. The speed of operation of variable speed motors in the article feeder assemblies are varied by controls for the apparatus. The speed of operation of a variable speed motor in a drive assembly for the conveyor is varied by the controls for the apparatus.

A receiving location sensor is associated with each of the receiving locations on the conveyor and each of the article feeder assemblies. The receiving location sensors provide output signals when the associated receiving location is in a predetermined positional relationship with an article feeder assembly. In addition, a feeder sensor is associated with each of the article feeder assemblies. The feeder sensor provides an operating signal when the associated article feeder assembly is in a predetermined operating condition. The controls are effective to control the operation of the article feeder assemblies as a function of output signals from the receiving location sensors and the feeder sensors.

It is contemplated that during operation of the apparatus the article feeder assemblies may occasionally fail to feed a sheet material article to a receiving location on the conveyor. A feed failure sensor is provided to sense a failure of an article feeder assembly to feed a sheet material article to a receiving location on the conveyor. When a feed failure sensor senses a failure to feed a sheet material article, the controls effect energization of a motor in a repair feeder assembly to feed a sheet material article to the receiving location which failed to receive a sheet material article from one of the article feeder assemblies.

During operation of the apparatus to form sheet material assemblages, it may be desired to advance or retard the operation of one of the article feeder assemblies relative to the other article feeder assemblies. To enable this to be accomplished, the controls include a feed adjustment which effects a change in the relationship of one of the article feeder assemblies relative to the other article feed assemblies during operation of the motors in the article feeder assemblies. Thus, while the motors in the article feeder assemblies are operating at a first speed, the speed of operation of a motor in one of the article feeder assemblies is changed while the motors in the other article feeder assemblies continue to run at the first speed.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENT

General Description

Figure 1:
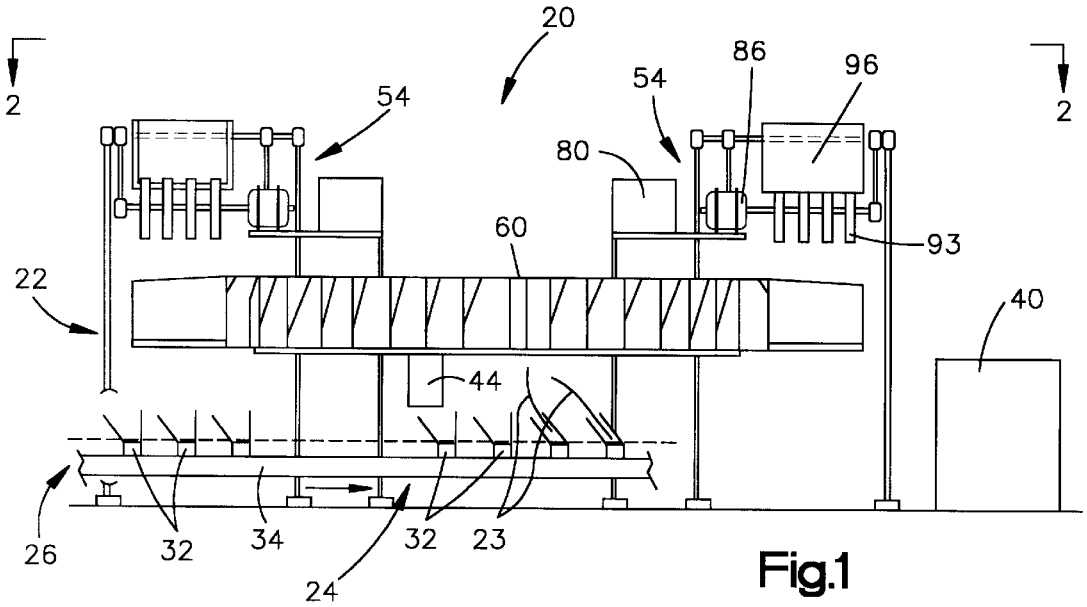
FIG. 1 is a schematic elevational view of an apparatus constructed in accordance with the present invention.
Figure 2:
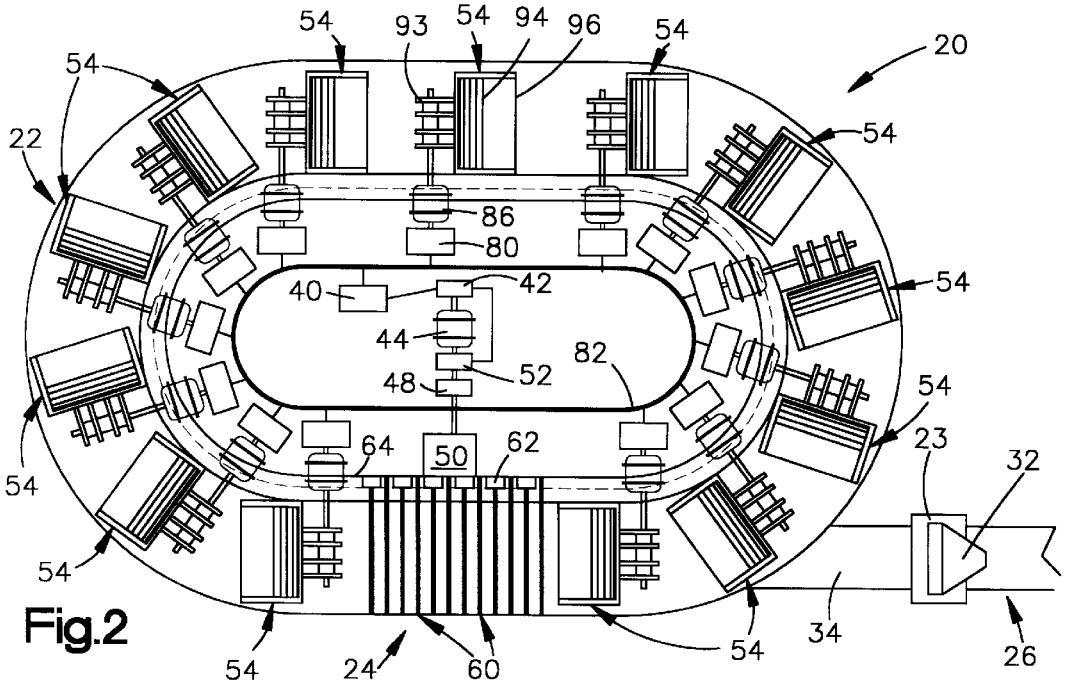
FIG. 2 is a schematic plan view taken along the line 2—2 of FIG. 1.

An apparatus 20 for forming sheet material assemblages is illustrated in FIGS. 1 and 2. Although the present invention could be used to form many different types of sheet material assemblages, the apparatus 20 includes a conveyor assembly 22 which forms complete newspapers 23. Each of the newspapers 23 has a jacket or folded outer cover section. Inserts are fed into the jackets during the forming of the complete newspapers 23.

Stationary sheet material article feeders 54 are located along the conveyor assembly 22. The conveyor assembly 22 has a delivery station 24 where the assembled newspapers 23 are delivered to a gripper conveyor assembly 26. The conveyor assembly 22 is located above the gripper conveyor assembly 26, as viewed in FIG. 1. The gripper conveyor assembly 26 transports the newspapers to receiving conveyors or other locations for further processing.

The gripper conveyor assembly 26 includes a plurality of identical grippers 32 which are interconnected by a conveyor chain (not shown). The conveyor chain is movable at a constant speed along a track 34. The grippers 32 are sequentially closed to engage the newspapers 23 at the delivery station 24. The grippers 32 are then moved from the delivery station 24 along the track 34.

Conveyor Drive and Controls

A main controller 40 (FIG. 3), preferably a microcomputer, is connected with a conveyor motor drive circuit 42. The conveyor motor drive circuit 42 is connected with a conveyor drive motor 44 for the conveyor assembly 22. The conveyor motor drive circuit 42 is also connected with a source of electrical power (not shown).

The conveyor motor drive circuit 42 provides electrical power to the conveyor drive motor 44. A device suitable for use as the conveyor motor drive circuit 42 is commercially available from the Indramat Division of the Rexroth Corporation, of Wood Dale, Ill. A suitable motor for use as the conveyor drive motor 44 is available from the Indramat Division of the Rexroth Corporation, of Wood Dale, Ill. It will be appreciated that other known motor drive circuits and motors may be used.

The main controller 40 (FIG. 3) provides electrical control signals to the conveyor motor drive circuit 42 which, in turn, controls the speed of the conveyor drive motor 44. The conveyor motor drive circuit 42 controls the speed of the conveyor drive motor 44 in response to control signals provided by the main controller 40. A home position sensor 45 provides an output to the main controller 40 when the conveyor assembly 22 is in a home or initial position relative to the sheet material article feeders 54.

The conveyor drive motor 44 (FIG. 3) is operatively coupled to a pocket conveyor 46 through a speed reducer 48 and a conveyor drive mechanism 50. The conveyor drive mechanism 50 is connected with a conveyor assembly 22 having the same general construction as is disclosed in U.S. patent application Ser. No. 08/719,997 filed Sep. 25, 1996 by Andrew L. Klopfenstein and entitled "Sheet Material Collating System", now U.S. Pat. No. 5,709,375. Alternatively, the conveyor assembly 22 may have a construction similar to the construction disclosed in U.S. Pat. No. 5,186,443.

A motor output shaft position sensor or signal generator 52, a known encoder, is operatively connected to the conveyor drive motor 44. The motor output shaft position sensor 52 (FIG. 3) is electrically connected to the conveyor motor drive circuit 42. The motor output shaft position sensor 52 provides an electrical feedback signal indicative of the position of the output shaft of the conveyor drive motor 44. The conveyor motor drive circuit 42 has an internal encoder emulator circuit (not shown) which receives the feedback signal, i.e., a series of pulses, from the motor position sensor 52.

If desired, the motor output shaft position sensor 52 could be a resolver. If the motor output shaft sensor 52 is a resolver, the internal encoder emulator circuit in the conveyor drive motor circuit 42 would convert the voltage and phase feedback signal into an electrical pulse signal.

When the main controller 40 is initially energized, a motor position counter (not shown) in the main controller 40 is set to zero. The pulse signal from the internal encoder emulator circuit of the conveyor motor drive circuit 42 is provided to the main controller 40 as a feedback signal to control the speed at which the conveyor drive motor 44 operates. The internal encoder emulator circuit in the conveyor motor drive circuit 42 provides 10,000 pulses per revolution of the output shaft of the conveyor drive motor 44. The counter in the main controller 40 counts the pulses to determine the position of the output shaft of the conveyor drive motor 44. Each time the conveyor drive motor completes a full revolution, i.e. the counter counts 10,000 pulses, the counter in the main controller 40 resets to zero.

The speed of the conveyor drive motor 44 is determined in the main controller 40 by totaling the number of pulses with respect to time. This enables the main controller 40 to control the speed of operation of the conveyor drive motor 44 through the conveyor motor drive circuit 42. It will be appreciated that the number of pulses per revolution may be different than 10,000, depending upon the desired resolution of the motor position. Of course, other known encoders could be used as the motor position sensor 52.

The pocket conveyor 46 of the conveyor assembly 22 has a plurality of interconnected pockets or sheet material receiving locations 60 which form a continuous oval conveyor loop (FIG. 2). The interconnected pockets 60 are supported by wheels 62 which ride on rails 64. The rails 64 form a continuous, generally oval, path along which the wheels 62 and pockets 60 are moved by the conveyor drive motor 44 and conveyor drive mechanism 50.

Each of the identical pockets 60 is a bottom opening pocket. When the pocket 60 is over the delivery station 24 a cam opens the bottom of the pocket and the newspaper 23 falls from the pocket 60 to a gripper 32. The gripper 32 firmly holds the newspaper 23 and moves the newspaper to a receiving location.

Figure 3:
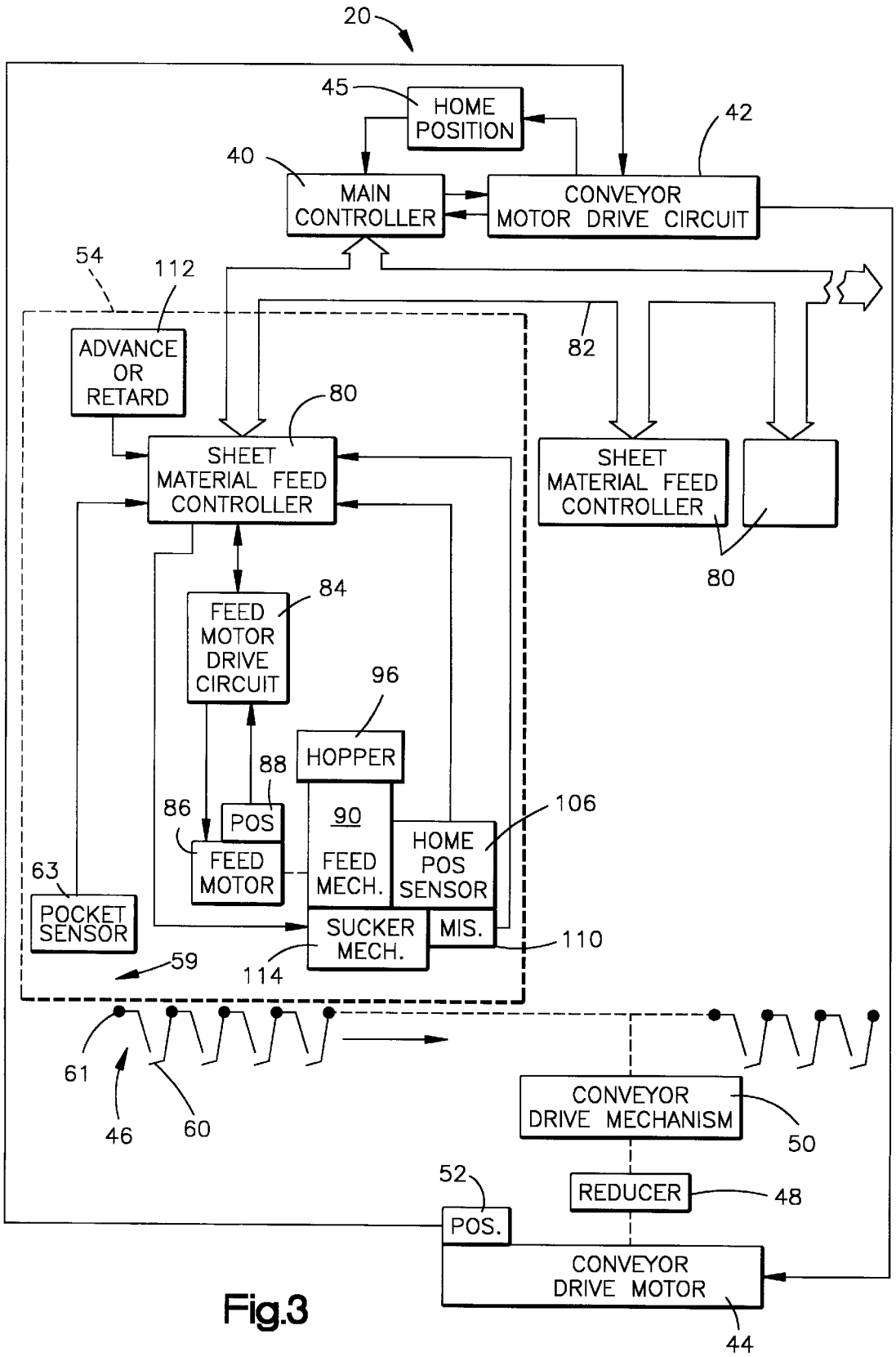
FIG. 3 is a schematic block diagram showing a portion of circuitry associated with the apparatus of FIG. 1.

During movement of the identical pockets or sheet material receiving locations 60 past the sheet material article feeders 54, sheet material articles are fed into each of the pockets. Each pocket 60 must be accurately located relative to a sheet material article feeder 54 when the sheet material article feeder begins to feed a sheet material article, that is, a jacket or insert for the newspaper 23, into a pocket 60. Although only a single sheet material feeder 54 is illustrated in FIG. 3, it should be understood that a plurality of identical sheet material feeders 54 are disposed in an oval array along the conveyor assembly 22 (FIG. 2).

A receiving location sensor assembly 59 (FIG. 4) provides an output signal when a pocket 60 is in a predetermined positional relationship with a sheet material article feeder 54. The receiving location sensor assembly 59 includes a plurality of pocket targets 61. Each of the pocket targets 61 is fixedly connected with and mounted on an associated one of the pockets 60. In addition, the receiving location sensor assembly 59 includes a plurality of pocket sensors 63. The pocket sensors 63 are fixedly mounted in predetermined positions relative to the sheet material article feeders 54. Thus, there is a pocket sensor 63 at each of the sheet material article feeders 54.

Upon movement of one of the pockets 60 into a predetermined position relative to one of the sheet material article feeders 54, the pocket target 61 on the one pocket moves into a predetermined position relative to a pocket sensor 63 at the one sheet material article feeder. When this happens, the pocket sensor 63 detects that the pocket target 61 is in the desired position relative to the sheet material article feeder 54. A sheet material article, that is, a newspaper insert, then begins to move into the pocket.

It is contemplated that the receiving location sensor assembly 59 may have many different constructions. Thus, in the embodiment of the invention illustrated in FIG. 4, the pocket target 61 is a piece of metal which is approximately 0.25 inches across. The pocket sensor 63 is an inductive proximity sensor. A suitable inductive proximity sensor or pocket sensor 63 is commercially available from Turck Inc. of 3000 Campus Drive, Minneapolis, Minn.

Although it is believed that it may be preferred to construct the receiving location sensor assembly 59 with a plurality of inductive type pocket sensors 63 to detect a metal pocket target 61, other known types of sensors could be utilized if desired. For example, a retroreflective sensor could be utilized if desired. Suitable retroreflective sensors are commercially available from Banner Engineering Corp., Inc. of 10th Avenue North, Minneapolis, Minn.

Feeder Drive and Controls

Figure 4:
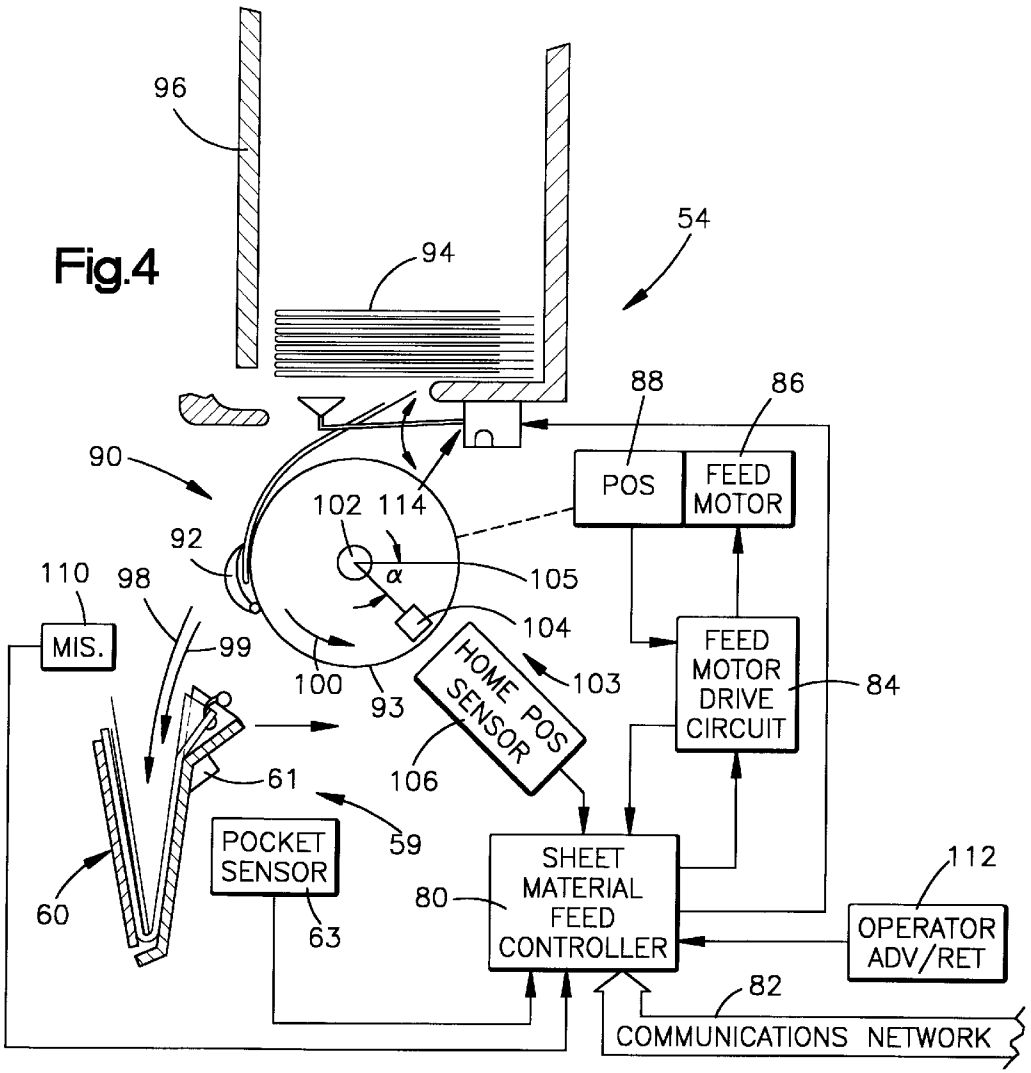
FIG. 4 is a schematic illustration a sheet material feeder and control circuitry in the apparatus of FIG. 1.

Referring to FIGS. 3 and 4, each of the identical sheet material article feeders 54 include a sheet material feed controller 80, such as a microcomputer. The sheet material feed controller 80 is controllably connected to the main controller 40 through a communications network 82. Although only a single sheet material article feeder 54 has been illustrated in FIGS. 3 and 4, it should be understood that there are a plurality of sheet material article feeders 54 arranged in an oval array (FIG. 2). Each of the sheet material article feeders 54 has the same construction and is connected with the main controller 40 through the communications network 82.

Preferably, the communications network 82 is in a ring configuration. It will be appreciated that other types of communication network configurations may be used to provide communications between the various controllers, e.g. star or daisy chain. Communication networks are known and are therefore not discussed in further detail.

The sheet material feed controller 80 is connected to a feed motor drive circuit 84. The feed motor drive circuit 84 is electrically connected to a feed motor 86 and a source of electrical power (not shown). The feed motor drive circuit 84 provides electrical power to the motor 86. A device suitable for use as the feed motor drive circuit 42 is available from the Indramat Division of the Rexroth Corporation of Wood Dale, Ill. A suitable motor for use as the feed motor 86 is available from the Indramat Division of the Rexroth Corporation of Wood dale, Ill. It will be appreciated that other known servomotor power supplies and motors may be used.

One specific embodiment of the sheet material feed controller 80 provides electrical control signals in a range from 0 volts to 10 volts to the feed motor drive circuit 84 which, in turn, controls the speed of the feed motor 86. The 0 volt command signal corresponds to the lowest desired motor speed and the 10 volt command signal corresponds to the highest desired motor speed. The feed motor drive circuit 84 controls the speed of the feed motor 86 by providing pulse-width-modulated current to the feed motor 86 in response to the control voltage signal provided by the sheet material feed controller 80. Other embodiments of the sheet material feed controller may use different electrical control signals, such as digital control.

In the feed motor drive circuit 84, the desired range of operating speeds of the feed motor 84 is selectively scaled. In one embodiment, the operating speed of the feed motor 84 is scaled to the range of control voltage provided by the sheet material feed controller 80. For example, a desired feed motor operating speed range of 0–2000 R.P.M. may be selected. In the example, this range of operating speeds would correspond with the 0 volt to 10 volt control voltage range of control voltage values provided to the feed motor drive circuit 84 by the sheet material feed controller 80. When the sheet material feed controller 80 of the example provides a 5 volt command signal to the feed motor drive circuit 84, the appropriate pulse-width-modulated drive current is applied to the feed motor windings by the feed motor drive circuit 84 to drive the motor at 1000 R.P.M.

The main controller 40 effects operation of the conveyor drive motor 44 to drive the pocket conveyor 46 (FIG. 3) at a desired speed. At the same time, the main controller 40 effects operation of the feed motors 86 in the sheet material article feeders 54 (FIGS. 2 and 3) at the same speed. Although the speed of operation of the feed motors 86 is different than the speed of operation of the conveyor drive motor 44, the operating speed of the feed motors 86 is related to the operating speed of the conveyor drive motor 44. Thus, for a selected conveyor drive motor operating speed, the main controller 40 selects a feed motor operating speed which results in proper feeding of sheet material articles to the pockets 60.

The scaling factor or a cam function routine for the feed motor drive circuit 84 and feed motor 86 may be selected such that the command voltage provided from the main controller 40 to the conveyor motor drive circuit 42 is the same control voltage required to command the feed motor drive circuit 84 to energize the feed motor 86 at a speed for proper timing to feed the sheet material 94 (FIG. 4) into the moving pockets 60. In the foregoing example, when the main controller 40 provides a 5 volt command voltage to the collating conveyor motor drive circuit 42 to drive the conveyor drive motor at 900 R.P.M., a 5 volt command signal is also provided to the sheet material feed controller 80 through the communications network 82 and the sheet material feed controller 80. The sheet material feed controller 80 uses the 5 volt command signal from the main controller 40 as a base command voltage signal. The 5 volt base command voltage signal is provided to the feed motor drive circuit 84. This results in the feed motor drive circuit 84 supplying the proper pulse-width-modulated drive current to the feed motor windings to drive the feed motor 86 at the proper speed to coordinate the speed of the feed mechanism 90 with the pocket conveyor speed for accurate feeding of sheet material 94 into the moving pockets 60.

It should be understood that the one-to-one scaling factor for the feed motor drive circuit 84 and feed motor 86 has been set forth only for purposes of clarity of description. Other scaling factors or cam functions may be used. It should also be understood that the foregoing ranges of motor operating speeds and ranges of electrical control signals have been set forth herein only for purposes of clarity of description. The invention should not be considered as being limited to any particular scaling factor, motor operating speed range, and/or ranges of control signal values.

A feed motor position sensor 88 is operatively connected to the feed motor 86 and is electrically connected to the feed motor drive circuit 84. Preferably, the feed motor position sensor 88 is an encoder. The feed motor position sensor 88 provides a series of electrical signal indicative of the position the output shaft of the feed motor 86. The output signals from the feed motor position sensor 88 are transmitted to the feed motor drive circuit 84. The feed motor drive circuit 84 has an internal encoder emulator circuit (not shown) which converts the position signals from the feed motor position sensor 88 into an electrical pulse signals indicative of the position of the output shaft of the feed motor 86. The pulse signal from the encoder emulator circuit in the feed motor drive circuit 84 is provided to the sheet material feed controller 80 as a feedback signal used to control the speed of the feed motor 86.

The encoder in the feed motor position sensor 88 provides 10,000 pulses per revolution of the output shaft of the feed motor 86. During system initialization, a counter (not shown) in a feed drum registration function 120 (FIG. 5) of the sheet material feed controller 80 is set to zero as described below. The counter counts the pulses from the encoder emulator circuit in feed motor drive circuit 84 to determine the position of the output shaft of the feed motor 86. Each time the feed motor 86 (FIG. 4) completes a full revolution, i.e. the counter counts 10,000 pulses, the counter in the feed drum registration function 120 (FIG. 5) of the sheet material feed controller 80 resets to zero. The speed of the feed motor 86 is determined by totaling the number of pulses with respect to time. The feed motor 86 is operatively connected to a sheet material feed mechanism 90.

The sheet material feed mechanism 90 includes a feed drum 93 (FIG. 4) which is connected to a feed drum drive shaft 102. The shaft 102 is located along a central longitudinal axis (not shown) of the feed drum 93. The shaft 102 is connected to the output shaft of the feed motor 86 through a gear reduction unit (not shown). In one specific embodiment of the invention, the gear reduction unit provides a 10 to 1 reduction of the rate of rotation of the output shaft of the feed motor 86.

The feed drums 93 in each of the sheet material article feeders 54 (FIG. 2) must be in predetermined positions relative to the pockets 60 upon initiation of feeding of a sheet material article, that is, a jacket or insert for the newspaper 23, into a pocket 60. A plurality of feeder sensor assemblies 103 are provided in association with the sheet material article feeders 54. Thus, there is one feeder sensor assembly 103 associated with each one of the sheet material article feeders 54. The feeder sensor assemblies 103 provide an output signal when an associated feed drum 93 (FIG. 4) is in a predetermined position relative to a hopper 96. When the feeder assembly 103 indicates that the feed drum 93 is in the predetermined position relative to the hopper 96, the feed drum may be considered as being in a home position.

The feeder sensor assembly 103 includes a home target 104 mounted on the feed drum 93. The home target 61 is a metal disk approximately 0.25 inch in diameter for affecting an inductive home position proximity sensor 106. The home position sensor 106 is electrically connected to the sheet material feed controller 80. The home position sensor 106 is operatively mounted adjacent to the feed drum 93 for providing an electrical signal when the home target 104 is within the operative distance of the home position sensor 106.

The pocket sensor 63 is electrically connected to the sheet material feed controller 80. The pocket sensor 63 is operatively mounted adjacent to the pocket conveyor 46 for providing an electrical signal when one of the pocket targets 61 is within the operative distance of the pocket sensor 63. A suitable device for the home position sensors 106 and the pocket sensors 63 are available as model number Ni 8U-M12-AN4X-H1141, from Turck Inc., 3000 Campus Dr., Minneapolis, Minn. 55441. Inductive proximity sensors and associated targets are known in the art and are not further discussed. It will be appreciated that other types of sensors and targets may be used to provide an electrical signal indicative of the location of the pocket or feed drum with respect to the sensor.

A sucker mechanism 114 (FIG. 4) is electrically connected to the sheet material feed controller 80. The sucker mechanism 114 engages an item of sheet material and uses a vacuum to pull the sheet material 94 from a hopper 96. The feed mechanism 90 has grippers 92 attached to the feed drum 93 for receiving and gripping sheet material 94 pulled from the hopper 96 by the sucker 114. The grippers 92 release the sheet material 94 at the proper time, thereby feeding it into the pockets 60, as shown by an arrow 98.

A misfeed sensor 110 is operatively mounted adjacent to the feed mechanism 90 and is electrically connected to the sheet material feed controller 80. The misfeed sensor 110 detects when a sheet material insert 94 is not fed into the pocket 60 and provides an electrical signal indicative of a misfeed to the sheet material feed controller 80. A suitable device for the misfeed sensor 110 is available as model number Q45BB6LVQ5 from Banner Engineering Corp., 9714 10th Ave. North, Minneapolis, Minn. 55441.

Figure 5:
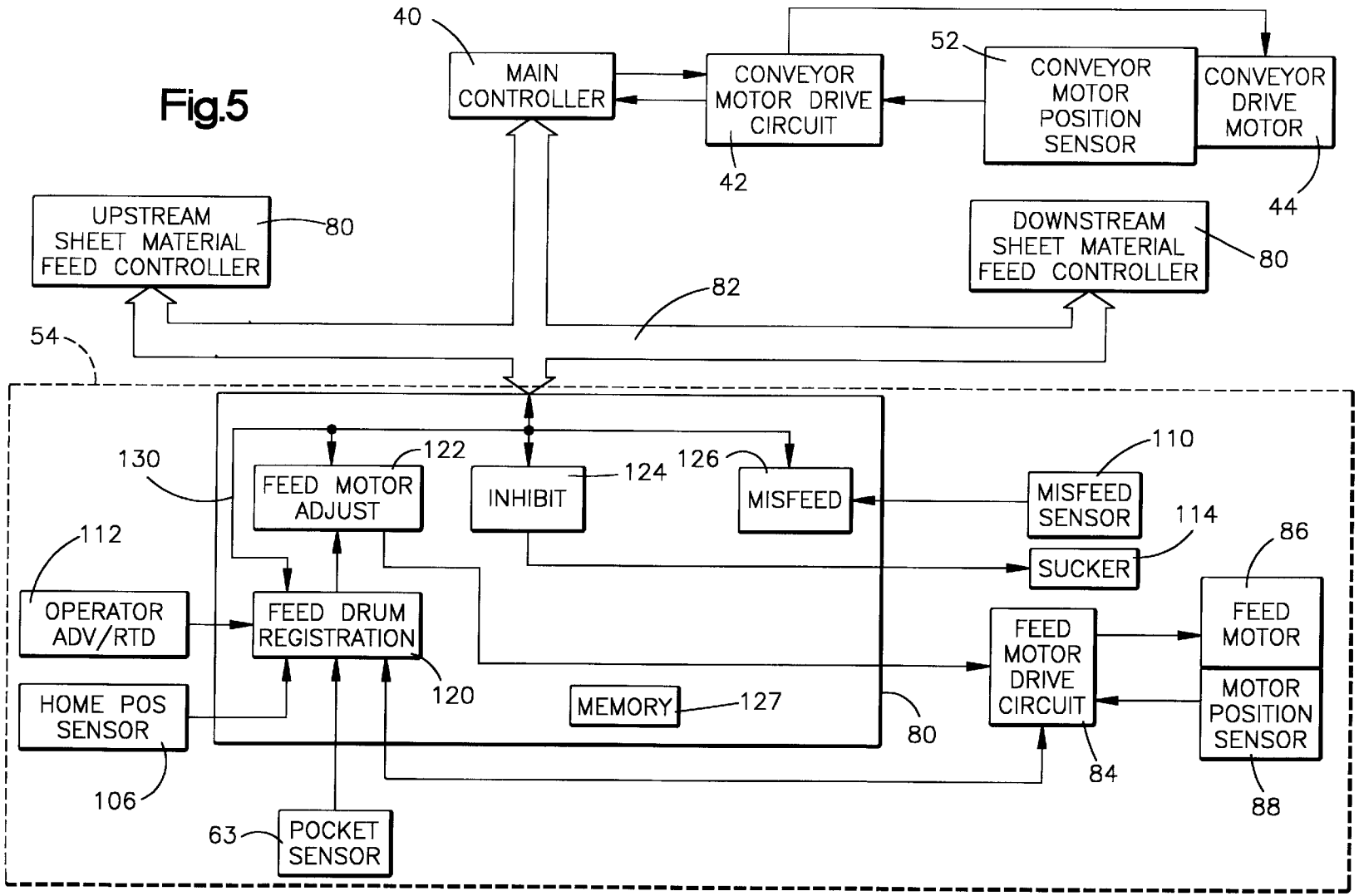
FIG. 5 is a functional block diagram of control circuitry for a sheet material feeder in the apparatus of FIG. 1.

Referring to FIG. 5, the functions performed internal to the sheet material feed controller 80 are shown in functional block diagram form. The sheet material feed controller 80 includes the feed drum registration function 120, a feed motor adjust function 122, an inhibit function 124, a misfeed function 126, and internal memory 127 for use by the various functions in the sheet material feed controller 80.

The feed drum registration function 120 is electrically connected to and receives signals from the home position sensor 106, the pocket sensor 63, the feed motor drive circuit 84, and the operator advance/retard 112. The feed drum registration function 120 is electrically connected to and provides electrical control signals to the feed motor adjust function 122.

The feed motor adjust function 122 is controllably connected to the main controller 40 through the communications network 82. The feed motor adjust function 122 provides electrical signals to and receives electrical signals from the main controller 40. The feed motor adjust function 122 is controllably connected to the feed motor drive circuit 84, which provides electrical power to the feed motor 86.

The inhibit function 124 is controllably connected to the main controller 40 through the communications network 82. The inhibit function 124 provides electrical signals to and receives electrical signals from the main controller 40. Control signals are provided by the inhibit function 124 to the sucker 114. Depending on the desired content of a newspaper, a specific sheet material feed mechanism 54 may be inhibited from feeding sheet material 94 from its hopper 96 into the pockets 60 of the pocket conveyor 46. Although the functions of only one of the sheet material feed controllers 80 has been shown in FIG. 5, it should be understood that the other sheet material article feeders 54 contain identical sheet material feed controllers which function in the same manner and have the same construction as the sheet material feed controller of FIG. 5.

A particular sheet material article feeder 54 may be designated to serve as a repair sheet material article feeder. A repair sheet material article feeder 54 is operable to feed sheet material into a specific pocket 60 when an upstream sheet material article feeder misfeeds its sheet material to the pocket. The repair sheet material article feeder 54 is inhibited from feeding inserts until instructed by the main controller to repair a misfeed. Thus, until instructed by the main controller 40, the feed motor 86 in the repair sheet material article feeder is maintained in a de-energized condition.

The misfeed sensor 110 is operatively connected to the misfeed function 126. The misfeed function 126 is controllably connected to the main controller 40 through the communications network 82. The misfeed function 126 provides signals to and receives signals from the main controller 40.

When the misfeed sensor 110 detects a misfeed from the feed mechanism 54, an electrical signal indicative of the misfeed is provided to the misfeed function 126 in the sheet material feed controller 80. The misfeed function 126 provides an electrical signal to the main controller 40 through the network 82 indicating (i) the occurrence of a misfeed to a specific one of the pockets 60, and (ii) the sheet material article feeder 54 at which the misfeed occurred. The main controller 40 then provides a misfeed repair signal to the proper downstream repair sheet material article feeder.

Each of the sheet material article feeders 54 which has been designated as a repair sheet material article feeder is associated with one or more of the upstream sheet material article feeders 54. A repair sheet material article feeder 54 may contain sheet material articles which are identical to the sheet material articles in an associated upstream sheet material article feeder. Alternatively, the repair sheet material article feeder may contain a generic sheet material article which can be substituted for a missed sheet material article in any one of a plurality of upstream sheet material article feeders 54. In order to provide time for a feed motor 86 in a repair sheet material article feeder 54 to be operated from a de-energized condition to an energized condition and to obtain a desired operating speed before a pocket 60 to which an upstream sheet material article feeder 54 failed to feed a sheet material article reaches the repair sheet material article feeder 54, there are a plurality of sheet material article feeders 54 between the repair sheet material article feeder and an associated upstream sheet material article feeder.

When instructed by the main controller 40, the feed motor adjust function 122 in the downstream repair feed mechanism initially provides a base voltage control signal from the main controller to the feed motor drive circuit 84 of the repair feed mechanism. The feed motor drive circuit 84 provides the proper pulse-width-modulated current supply to energize the feed motor 86 to synchronize the repair sheet material feeder mechanism 54 with the pocket conveyor 46. Thus, the feed motor 86 in the repair sheet material article feeder 54 is energized and accelerated to a desired operating speed before a repair sheet material article is fed.

The inhibit function 124 in the repair sheet material feed controller 80 receives a control signal from the main controller 40 to feed the repair sheet material into the proper pocket. The inhibit function 124 provides a control signal to actuate the sucker mechanism 114 to feed an item of the sheet material 94 into the pocket 60 for which the misfeed was detected.

Control Process

Figure 6:
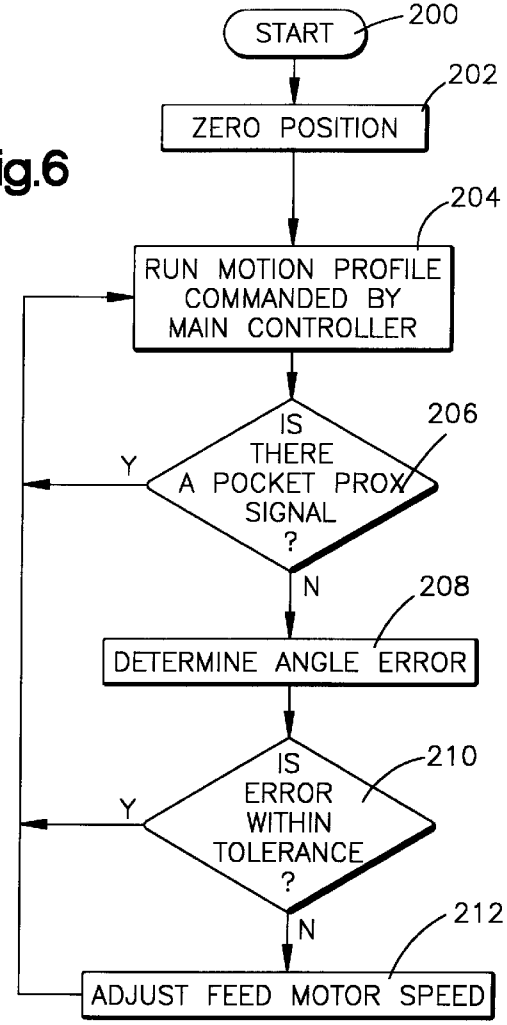
FIG. 6 (on sheet 3 of the drawings) is a flow diagram depicting part of a control process followed by the control circuitry for the apparatus of FIG. 1.

Referring to FIG. 6 taken in conjunction with FIG. 5, part of the control process of the present invention will be better appreciated. In step 200 (FIG. 6), the control process of the sheet material feed controllers 80 (FIG. 5) is initialized in which self-diagnostics of the controllers are performed, timers reset, memories are cleared, etc., as is well known in the art. The main controller 40 also performs its initialization process.

In step 202 (FIG. 6), the feed drum 93 (FIG. 4) is rotated by the feed motor 86 to and is stopped at a "home" position where the home target 104 is detected by the home position sensor 106. The feed drum registration function 120 (FIG. 5) sets the feed motor position counter described above to zero. When the feed drum 93 has been rotated to and stopped at the "home" position the feed drum 93 is also said to be in the absolute "zero" position.

In step 202, the pockets 60 are moved to and stopped at "home" positions where the home target 61 (FIG. 4) on each of the pockets 60 is adjacent to a pocket sensor 63. A conveyor position counter is then set to zero. Thus, both the conveyor assembly 22 and the sheet material article feeders 54 are operated to and stopped at a "zero" or "home" position.

The main controller 40 then instructs the conveyor motor drive circuit 42 to energize the conveyor drive motor 44. At the same time, the main controller 40 instructs the sheet material feed controller 80 in each of the sheet material article feeders 54 to energize the feed motors 86. The main controller 40 instructs the conveyor motor drive circuit 42 to accelerate the conveyor drive motor 44 to a desired speed. At the same time, the main controller 40 instructs the sheet material feed controllers 80 in the sheet material article feeder 54 to accelerate the feed motors 86 to a desired speed.

When the conveyor motor 44 has been accelerated to the desired speed and the sheet material feed motors 86 have been accelerated to the desired speed, the receiving location sensor assemblies 59 and the feeder sensor assemblies 103 will indicate when the conveyor drive motor 44 is in synchronism with the feed motors 86. In the event that the feed motors 86 are not in synchronism with the conveyor drive motor 44, the feed motor adjust function 122 in the sheet material feed controllers 80 effects a variation in the operating speed of the feed motors 86 so that the feeder sensor assemblies 103 in each of the sheet material article feeders 54 indicates that the feed drums 93 are in synchronism with the pockets 60.

In step 204 (FIG. 6), the main controller 40 (FIG. 5) provides the base command motor speed control voltage signals to (i) the conveyor motor drive circuit 42, and (ii) the sheet material feed controllers 80. The conveyor motor drive circuit 42 provides pulse-width-modulated current to the windings of the conveyor drive motor 44 to drive the conveyor motor 44 at the commanded motor speed. The conveyor motor position sensor 52 provides signals indicative of the rotational position of the output shaft of the conveyor drive motor 44 to the conveyor motor drive circuit 42.

The main controller 40 receives pulse feedback signals from the internal encoder emulator circuit of the conveyor motor drive circuit 42. The pulse signals transmitted to the main controller 40 from the conveyor motor drive circuit 42 are indicative of the position of the output shaft of the conveyor drive motor 44. The main controller 40 counts the number of pulse signals from the encoder emulator circuit in the conveyor motor drive circuit 42 with respect to time to determine the operating speed of the conveyor drive motor 44. The feedback signal from the conveyor motor drive circuit 42 to the main controller 40 (FIG. 5) is used to adjust the command voltage signal provided to the conveyor motor drive circuit 42 and the sheet material feed controllers 80.

The main controller 40 sends the pocket motor speed command signal voltage to the feed motor adjust functions 122 in all of the sheet material feed controllers 80 located along the collating conveyor assembly 22. The feed motor position sensor 88 provides signals indicative of the rotational position of the output shaft of the associated feed motor 86. The encoder emulator circuit in the sheet material feed controller 80 provides pulse signals to the main controller 40 indicative of the position of the output shaft of the feed motor 86. The main controller 40 counts the number of pulse signals from the sheet material feed controller 80 with respect to time to determine the operating speed of the feed motor 86. When the pocket conveyor 46 and the feed drums 93 are synchronized, the feed motor adjust function 122 in the sheet material feed controllers 80 provides the feedback adjusted conveyor motor speed command voltage signal from the main controller 40 to the feed motor drive circuit 84.

In step 206, a determination is made as to whether the pocket sensor 63 (FIG. 5) has provided a signal indicative of a pocket target 61 (FIG. 4) passing within the operative range of the pocket sensor 63. If the determination in step 206 (FIG. 6) is affirmative, the process returns to step 204. The feed motor adjust function 122 (FIG. 5) continues to provide the base command voltage to the feed motor drive circuit 84. It is to be understood that the main controller 40 provides the base command voltage signals (or motion command signals in a digital system) to the sheet material feed controllers 80 and that many command values from the main controller 40 are received by the sheet material feed controller 80 between the occurrence of signals from the pocket sensors 63.

If the determination in step 206 (FIG. 6) is negative, indicating that a pocket target 61 (FIG. 4) has passed the pocket sensor 63, the process proceeds to step 208. In step 208 (FIG. 6), the feed drum registration function 120 (FIG.

5) of the sheet material feed controller 80 determines the angle of error α (FIG. 4). When the pocket target is sensed prior to the feed drum passing the "zero" position (FIG. 4), the feed drum 93 is said to be lagging the pocket 60 and the sheet material will be fed late into the pocket. When the pocket 60 is sensed by the pocket sensor 63 after the feed drum 93 passes the "zero" position, the feed drum is said to be leading the pocket and the sheet material will be fed early into the pocket.

The feed drum registration function 120 (FIG. 5) determines the angle error α (FIG. 4) between a position 105 and the "zero" position of the feed drum corresponding to the location of the home position sensor 104. The position 105, illustrates the motor position when the feed drum registration function 120 (FIG. 5) received the pocket position sensor signal and that signal was received prior to the motor passing the "zero" position. In other words, indicating a lagging feed drum condition.

When the pocket target 61 (FIG. 4) passes within operative distance of the pocket sensor 63, the position of the feed motor 86 is determined in the feed drum registration function 120 (FIG. 5) by reading the number of pulses counted in the counter at the time that the sensor signal is provided by the pocket sensor 63. The angle error a (FIG. 4) is related to the motor position when the pocket sensor signal is received. The number of motor position pulses counted by the feed drum registration function 120 (FIG. 5) which indicate the angle error a are referred to as angle error counts. Recall that 10,000 pulses are provided for each revolution of the feed drum 60 and that the counter resets to zero upon each complete revolution of the motor. Thus, the angle error count is any non-zero motor position count at the time that the pocket sensor provides a signal. Once the feed drum registration function 120 reads the angle error count, the process proceeds to step 210 (FIG. 6).

In step 210, a determination is made as to whether the angle error α (FIG. 4), represented by the angle error count above, is within a predetermined range of tolerance. The acceptable range of angle error α corresponds to the position of the pocket target 61 being within plus or minus 1/16 of an inch of an optimum feed position of the feed drum 93 corresponding to the "zero" position described above and shown by an arrow 98 in FIG. 4. The feed drum registration function 120 (FIG. 5) compares the angle error count with a predetermined range of tolerance counts. If the number of angle error counts is within the predetermined range of tolerance counts, the error is within tolerance. For example, if the angle error count is greater than 9900 or less than 100, including zero, the angle error is within a window defining a range of tolerance counts and the process returns to step 204 (FIG. 6) where the feed motor adjust function 122 (FIG. 5) continues to command the feed motor drive circuit 84 at the base command voltage value provided by the main controller 40. It will be appreciated that the tolerance range of angle error counts is dependent upon the particular collating conveyor and feed mechanism, e.g. feed drum circumference, motor and conveyor speeds, distance of the pocket proximity sensor from the optimum feed position, etc.

If the determination in step 210 (FIG. 6) is negative, indicating that the angle error count is outside the predetermined range of tolerance counts, the feed drum registration function 120 (FIG. 5) provides an error command signal to the feed motor adjust function 122. The error command signal indicates that (i) the angle error count is out of tolerance, and (ii) whether the error is a lagging error or leading error. For example, when the angle error count is less than 9900 and greater than a predetermined intermediate number, e.g. 5,000, the feed drum is lagging the pocket at a rate which requires adjustment. When the angle error count is greater than 100 and is less than the intermediate number, i.e. 5,000, the feed drum is leading the pocket at a rate which requires adjustment. Thus, the motor position count provides an indication that the angle error is out of tolerance and whether the angle error is lagging or leading. The process then proceeds to step 212.

In step 212 (FIG. 6), the base command voltage signal provided by the main controller 40 (FIG. 5) is adjusted by the feed motor adjust function 122 to compensate for the angle error when it is outside the tolerance range. When the error command signal indicates that the feed drum 93 (FIG. 4) is lagging the pocket, the feed motor adjust function 122 (FIG. 5) provides a feed motor command voltage equal to a 10 percent increase added to the base command voltage signal provided from the main controller 40, i.e. 110% of the base command voltage signal. As the base command voltage signal continuously changes, the feed motor command voltage is continuously adjusted to equal 110% of the base command voltage signal.

The percentage value of the increase in base command voltage to provide the adjusted feed motor command voltage is empirically determined for a specific conveyor system. It will be appreciated that other empirically determined percentage values may be used to adjust the feed motor speed depending on specific conveyor systems and desired feed motor speed recovery time. The 10 percent increase in feed motor command voltage greater than the base command voltage value is continuously provided to the feed motor drive circuit until the angle error count is within the tolerance range.

When the error command signal indicates that the feed drum 93 (FIG. 4) is leading the pocket 60, the feed motor adjust function 122 (FIG. 5) provides a feed motor command voltage that is 10% less than the base command voltage signal provided from the main controller 40, i.e. 90% of the base command voltage. The 10 percent decrease in feed motor command voltage less than the base command voltage value and is continuously provided to the feed motor drive circuit until the angle error count is within the tolerance range. The process then returns to step 204 (FIG. 6) and continues to loop as described above.

It is to be understood that there may be more than one delivery of sheet material per full revolution of the feed drum 93. For example, there may be multiple sets of fingers 92 (FIG. 4) for feeding one item of sheet material per each half revolution of the feed drum, i.e. every 180 degrees of feed drum rotation. In such systems, one skilled in the art will appreciate that, additional optimum feed positions of the feed drum exist. If there are two sets of sheet material fed per revolution the motor position counter in the feed drum registration function 120 (FIG. 5) would reset after 5,000 pulses were counted. The window defining the range of tolerances for angle error counts is appropriately adjusted.

Referring to FIG. 4, there are occasions when it is desirable to feed sheet material 94 from the hopper 96 either earlier or later than the optimum feed position indicated by the feed arrow 98. For example, as the newspapers are formed along the conveyor the pocket volume is filled with sheet materials resting along the left interior surface of the pocket 60, as viewed in FIG. 4. As the pocket continues to fill, it is desirable to feed the sheet material into the pocket earlier, as shown by an arrow 99.

An operator advance/retard 112 (FIG. 4) control is electrically connected to the feed drum registration function 120

(FIG. 5) of the sheet material feed controller 80. The operator advance/retard control 112 is used by a machine operator to advance or retard the feed position of the feed drum by setting a "relative home" position different than the home position which corresponds to the absolute "zero" position set during system initialization in step 202 above. To advance or retard the home position from its absolute "zero" position set during system initialization, the operator "jogs" the feed drum in the desired direction by using the operator advance/retard control 112.

The operator advance/retard control 112 provides an electrical signal to the feed drum registration function 120 which, in turn, provides a corresponding jog command signal to the feed motor adjust function 122. The feed motor adjust function 122 provides a jog command voltage signal to the feed motor drive circuit 84. The feed motor drive circuit 84 provides electrical power to the motor windings of the feed motor 86 to move the feed drum 1/32 inch in the desired direction for each jog command.

For convenience, assume that each jog command corresponds to motor rotation equivalent to one position count from the internal encoder in the feed motor drive circuit 84. When an operator advances the feed drum 93 (FIG. 4) into a leading position by 5 motor position counts, the feed drum registration function 120 (FIG. 5) centers the angle error count tolerance window at the new "relative home" position of 5 counts. For the tolerance range described in the example above, centered at the new "relative home" of 5 counts, if the angle error count is greater than 9905 or less than 105, including zero, the angle error is within the new angle error tolerance window centered on the new relative home. When the angle error count is within the shifted tolerance range, the process returns to step 204 where the feed motor adjust function 122 continues to command the feed motor drive circuit 84 at the base command voltage value provided by the main controller 40. When the angle error count is outside the shifted tolerance range the feed motor adjust function 122 provides the adjusted feed motor command voltage to the feed motor drive circuit 84, as required.

It is also contemplated that the feed motor 86 may be advanced or retarded to a new "relative home" position by the main controller 40 in response to a signal indicative of pocket conveyor velocity. The main controller 40 is controllably connected to the feed drum registration function 120 by the line 130 shown in FIG. 5. When the pocket conveyor operates at higher velocity it is desirable to feed the sheet material inserts into the moving pockets earlier than the optimum feed position.

Figure 7:
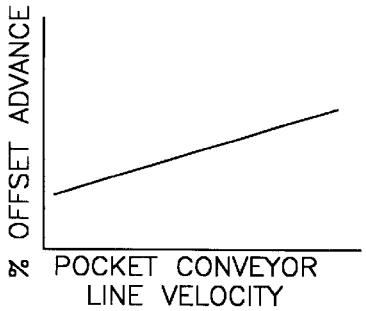
FIG. 7 (on sheet 1 of the drawings) is a graphical representation illustrating a percentage of feed drum advance with respect to pocket conveyor line velocity.

Referring to FIG. 7, a graphical representation is shown illustrating the percentage of desired feed drum advance with respect to pocket conveyor line velocity. The main controller 40 has a look-up table of values stored in an internal memory (not shown) corresponding to the graph illustrated in FIG. 7. The conveyor motor drive circuit 42 (FIG. 5) provides motor position pulses to the main controller 40. The main controller 40 determines the velocity of the pockets 60 in response to the totaled number of position counts with respect to time. Once the pocket velocity is determined, the main controller 40 uses the look-up table to determine the desired percent offset advance command.

The percent offset advance command is provided by the main controller 40 (FIG. 5) on the line 130 to the feed drum registration function 120 in the sheet material feed controller 80. A new "relative home" position is determined by the feed drum registration function 120 in response to the percent offset advance command. The feed drum registration function 120 then determines values for the shifted motor position angle error count tolerance window.

For example, a 0.1 percent offset advance command from the main controller 40 results in the feed drum registration function 120 (FIG. 5) shifting the center of the angle error count tolerance window from absolute "zero" to the new "relative home" of 10 counts. The new angle error tolerance range for the angle error count is a count value greater than 9910 and less than 110 counts. A motor position count value falling within the tolerance range does not require adjustment of feed motor command. The actual relationship between desired percentage offset advance and the number of shifted counts for the new "relative home" position is determined empirically for a specific collating conveyor system.

Once the new "relative home" position is established by the feed drum registration function 120, the system operates as described above. It will be appreciated that as pocket conveyor velocity changes, the main controller 40 updates the percentage offset advance command provided to the feed drum registration function 120. As the percentage offset advance command signal changes, the feed drum registration function 120 determines an updated "relative home" position. The count values for the shifted angle error count tolerance window are also updated. The main controller 40 may provide percent offset command signals which retard the feed position of the feed drum.

The foregoing description has been in conjunction with an apparatus 20 which is used to form newspapers 23. However, it is contemplated that many different known types of sheet material forming apparatus could be utilized in conjunction with the forming of many different types of sheet material assemblages. For example, the present invention could be utilized in conjunction with the forming of magazines and/or pamphlets. Although the present invention is described herein in conjunction with a conveyor assembly 22 having pockets 60, it is contemplated that the present invention could be utilized in conjunction with either a saddle type conveyor or a conveyor having sheet material receiving locations which move along a flat bed or base. It should also be understood that various features of the present invention may be utilized either separately or in combination with each other.

From the above description of the invention, those skilled in the art will perceive improvements, changes and modifications. Such improvements, changes and modifications within the skill of the art are intended to be covered by the appended claims.

What is claimed is:

1. An apparatus for use in forming sheet material assemblages, said apparatus comprising:

a conveyor having a plurality of sheet material receiving locations;

a plurality of article feeder means disposed along said conveyor for feeding sheet material articles to said receiving locations, each one of said article feeder means includes a variable speed motor which varies the speed of operation of said one article feeder means;

conveyor drive means for driving said conveyor to move said sheet material receiving locations relative to said plurality of article feeder means, said conveyor drive means includes a variable speed motor which varies the speed of operation of said conveyor; and control means for varying the speed of operation of said variable speed motors in said plurality of article feeder means and the speed of operation of said variable speed motor in said conveyor drive means.

2. An apparatus as set forth in claim 1 wherein each of said article feeder means includes an article feeder element which is moved by one of said variable speed motors to effect feeding of sheet material articles and means for providing signals indicative of the position of said article feeder element, said control means varies the speed of operation of each of said variable speed motors in said article feeder means as a function of said signals.

3. An apparatus as set forth in claim 1 further including means for providing signals to said control means indicative of the positions of said article receiving locations relative to said article feeder means.

4. An apparatus as set forth in claim 1 further including sensor means for sensing a misfeed to one of said sheet material receiving locations by an article feeder means of said plurality of article feeder means, said control means operates a feeder motor in an article feeder means in said plurality of article feeder means from a nonoperating condition to an operating condition in response to said sensor means sensing a misfeed at one of said sheet material receiving locations.

5. An apparatus as set forth in claim 1 wherein said control means varies the operating speed of said variable speed electric motor in one article feeder means of said plurality of article feeder means relative to the operating speed of said variable speed electric motors in other article feeder means of said plurality of article feeder means.

6. An apparatus as set forth in claim 1 wherein said variable speed motor in said conveyor drive means has an output member which is connected with said conveyor, each of said article feeder means includes an article feeder element which moves sheet material articles, each one of said variable speed motors in said plurality of article feeder means having an output member which is connected with one of said article feeder elements, said conveyor drive means including means for providing an output signal to said control means indicative of the position of said output member of said variable speed motor in said conveyor drive means, each one of said article feeder means includes means for providing an output signal to said control means indicative of the position of said output member of said variable speed motor in said one of said article feeder means, said control means including means for varying the speed of operation of said variable speed motors in said plurality of article feeder means as a function of the signals from said means in said article feeder means for providing an output signal.

7. An apparatus as set forth in claim 1 wherein said each of said article feeder means includes an article feeder element which is moved by one of said variable speed motors in said article feeder means to feed sheet material articles, and sensor means for providing an output signal when said article feeder element is in a predetermined position, said control means varies the speed of operation of at least one of said variable speed motors in said article feeder means as a function of said output signals provided by said sensor means.

8. An apparatus as set forth in claim 7 wherein said sensor means includes a first component which moves with said article feeder element relative to a second component of said sensor means, said sensor means provides an output signal when said first component of said sensor means is in a predetermined position relative to said second component of said sensor means.

9. An apparatus as set forth in claim 1 further including sensor means for providing output signals when said receiving locations are in predetermined positions relative to said article feeder means.

10. An apparatus as set forth in claim 9 wherein said sensor means includes first and second components, said first component of said sensor means being movable with said receiving locations relative to said article feeder means and to said second component of said sensor means, said sensor means provides an output signal when said first component of said sensor means is in a predetermined position relative to said second component of said sensor means.

11. An apparatus as set forth in claim 1 wherein each of said article feeder means includes an article feeder element which is moved by one of said variable speed motors in said article feeder means feed sheet material articles, and means for providing signals to said control means indicative of the position of each of said article receiving means in turn relative to said article feeder element in each of said article feeder means, said control means including means for determining whether said article receiving locations and said article feeder elements in one of said article feeder means are in a desired relationship and means for varying the speed of operation of said variable speed motor in said one of said article feeder means to vary the position of said article feeder element in said one of said article feeder means in response to said control means determining that said article receiving locations and said article feeder element in said one article feeder means are in a relationship other than the desired relationship.

12. An apparatus as set forth in claim 1 wherein said control means includes a main controller which controls the speed of operation of said variable speed motor in said conveyor drive means and a plurality of sheet material feeder controllers which are connected with said main controller, each of said sheet material feed controllers being connected with one of said variable speed motors in one of said article feeder means and with said main controller.

13. An apparatus for use in forming sheet material assemblages, said apparatus comprising:

a conveyor having a plurality of receiving locations for receiving sheet material articles;

a plurality of article feeder means disposed along said conveyor for feeding sheet material articles to said receiving locations, each of said article feeder means includes a variable speed motor;

conveyor drive means for driving said conveyor to move each of said receiving locations past each of said article feeder means in turn;

a plurality of receiving location sensor means each of which is associated with a receiving location of said plurality of receiving locations and provides an output signal when the associated receiving location is in a predetermined positional relationship with an article feeder means of said plurality of article feeder means;

a plurality of feeder sensor means each of which is associated with an article feeder means of said plurality of article feeder means and provides an output signal when the associated article feeder means is in a predetermined operating condition; and control means for controlling operation of said plurality of article feeder means as a function of output signals from said receiving location sensor means and said feeder sensor means, said control means varies the speed of operation of said variable speed motor in one of said article feed means in response to one of said feeder sensor means of said plurality of feeder sensor means and one of said receiving location sensor means in said plurality of receiving location sensor means providing output signals indicative of a relationship between one of said receiving locations and one of said article feeder means other than a desired relationship.

14. An apparatus as set forth in claim 13 wherein each of said article feeder means includes a feeder element which is movable to feed sheet material articles to said receiving locations in said conveyor, each of said feeder sensor means including a component which is movable with said feeder element.

15. An apparatus as set forth in claim 13 wherein said plurality of receiving location sensor means include a plurality of first components each of which moves with one of said receiving locations relative to said plurality of article feeder means and a plurality of second components each of which is disposed adjacent to one of said article feeder means of said plurality of article feeder means.

16. An apparatus as set forth in claim 13 wherein each of said article feeder means operates at a selected speed in a range of speeds and said conveyor drive means operates at a selected speed within a range of speeds, said control means includes means for varying the speed of operation of each of said article feeder means upon variations in the speed of operation of said conveyor drive means.

17. An apparatus as set forth in claim 13 wherein said control means includes a plurality of sheet material feed controllers each of which is connected with a receiving location sensor means and a feeder sensor means at one of said receiving locations, each of said sheet material feed controllers controls operation of one of said article feeder means of said plurality of article feeder means.

18. An apparatus for use in forming sheet material assemblages, said apparatus comprising:

a conveyor having a plurality of sheet material receiving locations;

a plurality of article feeder means disposed along said conveyor for feeding sheet material articles to said receiving locations;

feed failure sensor means for sensing a failure of one of said article feeder means to feed a sheet material article to one of said sheet material receiving locations;

repair feeder means disposed along said conveyor for feeding sheet material articles to sheet material receiving locations to which said one article feeder means of said plurality of article feeder means fails to feed sheet material articles, said repair feeder means includes a feeder element which feeds sheet material articles and a motor connected with said feeder element, said motor being operable between a de-energized condition in which said motor is ineffective to move said feeder element and an energized condition in which said motor moves said feeder element;

control means connected with said feed failure sensor means and said motor for effecting operation of said motor from the de-energized condition to the energized condition in response to said feed failure sensor means sensing a failure of said one of said article feeder means to feed a sheet material article and receiving location sensor means for providing an output signal upon movement of each of said receiving locations in turn to a predetermined position relative to said repair feeder means, said control means operates said repair feeder means in response to an output signal from said receiving location sensor means.

19. An apparatus as set forth in claim 18 further including conveyor drive means for driving said conveyor to move sheet material receiving locations relative to said plurality of article feeder means and to said repair feeder means, said conveyor drive means includes a variable speed motor which varies the speed of operation of said conveyor, said control means operates said motor in said repair feeder means at a speed which is a function of the speed of operation of said variable speed motor in said conveyor drive means during operation of said repair feeder means.

20. An apparatus for use in forming sheet material assemblages, said apparatus comprising:

a conveyor having a plurality of sheet material receiving locations;

a plurality of article feeder means disposed along said conveyor for feeding sheet material articles to said receiving locations, each of said article feeder means includes a motor;

conveyor drive means for driving said conveyor to move said sheet material receiving locations relative to said plurality of article feeder means; and control means for operating said motors in said article feeder means at a first speed to feed sheet material articles to said sheet material receiving locations during movement of said sheet material receiving locations by said conveyor drive means, said control means including feed adjust means for changing the relationship of a first one of said article feeder means of said plurality of article feeder means relative to other article feeder means of said plurality of article feeder means during operation of said motors in said plurality of article feeder means at the first speed, said feed adjust means including means for changing the operating speed of said motor in said first one of said article feeder means from the first speed to a second speed while the motors in said plurality of article feeder means other than said first one of said article feeder means continue to operate at the first speed and for changing the operating speed of said motor in said first one of said article feeder means from the second speed back to the first speed while the motors in said plurality of article feeder means other than said first one of said plurality of article feeder means continue to operate at the first speed.

21. An apparatus as set forth in claim 20 wherein said conveyor drive means includes a motor which is operated to drive said conveyor and move said sheet material receiving locations relative to said article feeder means during operation of said motors in said article feeder means, said control means maintains an operating speed of said motor in said conveyor drive means constant as said control means effects a change in the operating speed of said motor in said first one of said article feeder means from the first speed to the second speed and from the second speed back to the first speed.

22. An apparatus as set forth in claim 20 wherein each of said article feeder means includes an article feeder member which is moved by one of said motors to effect the feeding of sheet material articles, said apparatus further including a plurality of feeder sensor means each of which is associated with one of said article feeder means of said plurality of article feeder means and provides an operating signal when the associated one of said article feeder means is in a predetermined operating condition, each of said feeder sensor means includes first and second components, said first component of each of said feeder sensor means moved relative to said second component of each of said feeder sensor means during operation of said motors in said article feeder means at the first speed, said first component of said feeder sensor in said first one of said article feeder means being moved relative to said first components of said feeder sensors in said article feeder means other than said first article feeder means upon operation of said motor in said first one of said article feeder means at the second speed during operation of the motors in said article feeder means other than the first article feeder means at the second speed.

23. An apparatus as set forth in claim 20 further including feed failure sensor means for sensing a failure of one of said article feeder means to feed a sheet material article to one of said sheet material receiving locations, and repair feeder means disposed along said conveyor for feeding sheet material articles to sheet material receiving locations to which said feed failure sensor means senses a failure of one of said article feeder means to feed a sheet material article, said repair feeder means includes a feeder element which feeds a sheet material article and a motor connected with said feeder element, said motor in said repair feeder means being operable between a de-energized condition in which said motor in said repair feeder means moves said feeder element and an energized condition in which said motor in said repair feeder means is effective to move said feeder element, said control means being connected with said feed failure sensor means and said motor in said repair feeder means and being operable to effect operation of said motor in said repair feeder means from the de-energized condition to the energized condition in response to said feed failure sensor means sensing a failure of one of said article feeder means to feed a sheet material article.

24. An apparatus for use in forming sheet material assemblages, said apparatus comprising:

a conveyor having a plurality of sheet material receiving locations;

a plurality of article feeder means disposed along said conveyor for feeding sheet material articles to said receiving locations, each of said article feeder means includes a motor;

a plurality of feeder sensor means each of which is associated with one of said article feeder means of said plurality of article feeder means and provides an operating signal when the associated one of said article feeder means is in a predetermined operating condition;

conveyor drive means for driving said conveyor to move said sheet material receiving locations relative to said plurality of article feeder means, said conveyor drive means includes a motor which is operated to drive said conveyor to move said sheet material receiving locations relative to said article feeder means during operation of said motors in said article feeder means; and control means for operating said motors in said article feeder means at a first speed to feed sheet material articles to said sheet material receiving locations during movement of said sheet material receiving locations by said conveyor drive means, said control means includes a main controller which is connected with said motor in said conveyor drive means and controls the operation of said motor in said conveyor drive means, and a plurality of sheet material feed controllers which are connected with said main controller and with one of said motors in one of said article feeder means and with one of said feeder sensor means, each of said sheet material feed controllers being operable to control the operation of one of said motors in one of said article feeder means.

* * * * *